United States Patent [19]

Gresens

[11] Patent Number: 4,918,796

[45] Date of Patent: Apr. 24, 1990

[54] TENSIONING MACHINE

[75] Inventor: Harry Gresens, Benningen, Fed. Rep. of Germany

[73] Assignee: Bruckner Trockentechnik GmbH & Co. KG, Leonburg, Fed. Rep. of Germany

[21] Appl. No.: 725,903

[22] Filed: Apr. 22, 1985

[30] Foreign Application Priority Data

Jun. 28, 1984 [DE] Fed. Rep. of Germany ..... 3423905
Aug. 31, 1984 [DE] Fed. Rep. of Germany ..... 3432177

[51] Int. Cl.[5] ..... B65H 23/028; D06C 3/04
[52] U.S. Cl. ..... 26/94
[58] Field of Search ..... 26/94, 95; 474/239, 474/242, 252, 265

[56] References Cited

U.S. PATENT DOCUMENTS 2,296,740 9/1942 Reiling ..... 474/252
2,404,271 7/1946 Brunner ..... 474/265
2,414,010 1/1947 Baumann ..... 26/94
2,574,928 11/1951 Mather ..... 26/94
2,945,280 7/1960 Liebert ..... 26/95
3,098,778 7/1963 Garner ..... 474/252

FOREIGN PATENT DOCUMENTS 12611 of 1914 United Kingdom ..... 26/94

*Primary Examiner*—Werner H. Schroeder
*Attorney, Agent, or Firm*—Learman & McCulloch

[57] ABSTRACT

A tensioning machine for the continuous treatment of a length of textile material comprises a pair of moving conveyor devices having parallel runs provided with a plurality of grippers. A mechanism for closing the grippers is provided at the inlet end of the conveyor runs and a mechanism for opening the grippers is provided at the outlet end of the conveyor runs. Each of the mechanisms includes a moving actuating device which is driven synchronously with the conveyors and moves in the same direction and at the same speed as the grippers. The tensioning machine is particularly suitable for comparatively high conveying speeds.

14 Claims, 6 Drawing Sheets

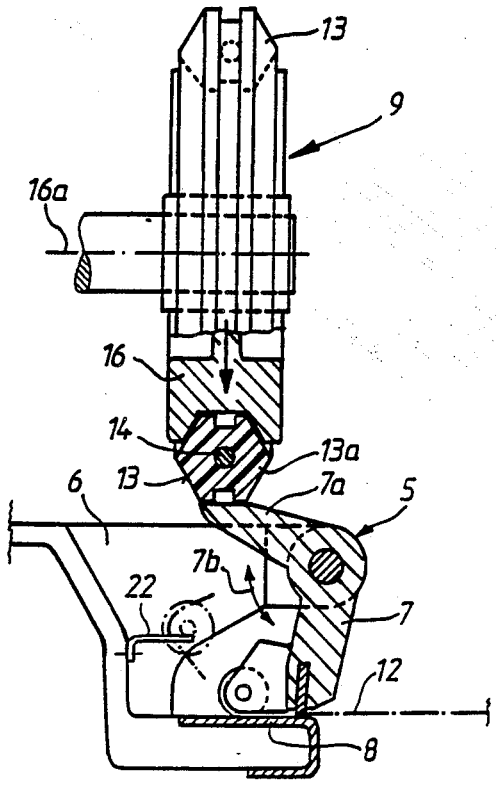
FIG. 2
FIG. 3
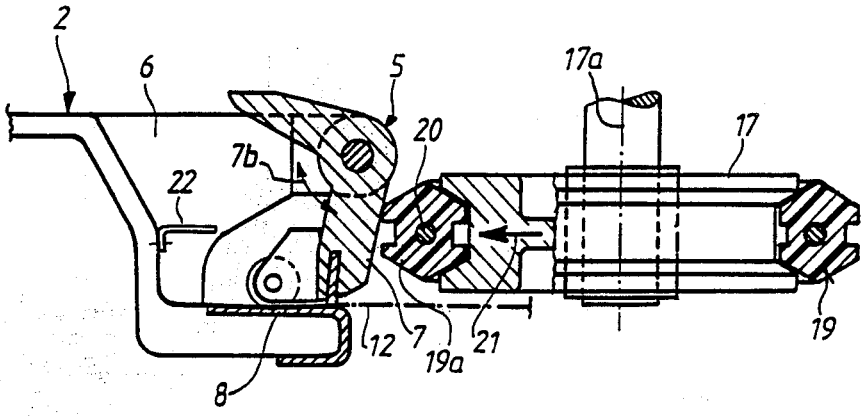

TENSIONING MACHINE

The invention relates to a tensioning machine for the continuous treatment of a length of textile material.

BACKGROUND OF THE INVENTION

Machines for tensioning lengths of textile material are well known in the art for various types of treatment, e.g., drying and fixing of lengths of textile material. A length of material to be treated is conveyed continuously in the longitudinal direction through the tensioning machine with the aid of two suitable, continuously moving conveyor devices (e.g., chains or belts provided with grippers), and its edges are held by the grippers carried on the conveyor devices. For this purpose, each gripper has a gripper flap which can be moved towards the gripper table and can be pivoted between an open position and a closed position. This opening and closing of the gripper flaps is carried out with the aid of appropriate means which are provided at the inlet end and at the outlet end of the tensioning machine. In most of the known tensioning machines, these openers and closers are formed by static arrangements, e.g., by a type of guide bar, which are arranged in the region of the turning ends of each continuously moving conveyor device in such a way that they can be brought into sliding engagement with the gripper flaps or pivot actuating levers connected thereto for the purpose of closing or opening the gripper flaps.

This construction and co-operation of the grippers and the closing and opening arrangements for the gripper flaps can be regarded as fairly satisfactory so long as the conveyor devices move at relatively low speed. However, in the more modern constructions of tensioning machines, higher operating and conveying speeds (up to 300 m/min and more) are increasingly aimed for. These high speeds lead to an extremely rapid wear of the closing and opening arrangements on the one hand and the grippers on the other hand, in particular the gripper flaps which are in frictional engagement with these arrangements, so that the advantage of the high operating speeds is cancelled out by undesirable shutdown periods and by particularly high repair and maintenance costs, that is to say by quite considerable disadvantages.

The object of the invention, therefore, is to improve a tensioning machine of the type referred to, particularly in the region of co-operation between the grippers and the closing and opening arrangements for the gripper flaps, in such a way that even at very high operating and conveying speeds the wear on the closing and opening elements and on the gripper flaps is largely eliminated or reduced to a minimum and at the same time, even at these speeds, a reliable closing and opening function is ensured.

SUMMARY OF THE INVENTION

In the construction according to the invention, the mechanisms for closing and opening the gripper flaps essentially each contain a moving actuating device which is adapted in its speed and direction to the appertaining conveyor device or the grippers so that relative speeds between the gripper flaps and the actual closing and opening elements can be reduced to a minimum, whereby frictional wear occurring as a result thereof on these parts can be reduced to an acceptable minimum and usually reduced quite considerably further.

If in this construction of a tensioning machine each gripper flap has a pivot actuating lever projecting over the upper surface of the gripper body and the gripper flaps of the strand of the conveyor devices running back to the inlet of the tensioning machine are held by a spring rest element in the open position, then it is particularly advantageous if the mechanism for closing the gripper flaps is arranged above the conveyor device and the moving actuating device in the case of a horizontal axis of rotation can be brought into an approximately vertically oriented closed contacting engagement with the pivot actuating levers of the gripper flaps.

Furthermore, it is preferred for the mechanisms for opening the gripper flaps to be arranged on the side facing the length of material adjacent to the conveyor device and above the plane of conveying the length of material and for the moving actuating device in the case of an approximately vertically oriented axis of rotation to be capable of being brought into an essentially horizontally oriented open contacting engagement with the gripper flaps.

In these arrangements of the actuating devices, a conventional gripper construction can generally be used, in which the mechanisms for closing and opening the gripper flaps are arranged in each case in the most convenient position for them and can act with a particularly favorably oriented force on the gripper flaps.

In the tensioning machine according to the invention, two basic forms of construction of the actuating device have proved particularly advantageous. In a first embodiment, both the actuating device of the mechanism for closing the gripper flaps and the actuating device of the mechanism for opening the gripper flaps can be formed by a continuously moving element which is led over turning wheels, and the strand thereof coming into contacting engagement with the gripper flap can be driven in the same direction and at the same speed as the gripper flap.

A second embodiment of the invention is characterized in that the actuating device, at least of the mechanism for opening the gripper flaps, is formed by a wheel, the periphery of which comes into contact with the closed gripper flaps and has a plurality of cam surfaces rising in the radial direction. The distribution of the cam surfaces on the periphery of the wheel is advantageously adapted to the spacing of the grippers and the conveyor devices. In an advantageous manner, the construction of these rising cam surfaces can be such that the gripper flaps are caught up to some extent without jerking by the continually curving or continually rising cam surfaces at the first point of contact with the cam surfaces and moved into the open position. In an extremely favourable manner, these cam surfaces can be adapted to the shape of the gripper flaps, and the wheel forming the actuating device requires a relatively small space.

In a tensioning machine in which the gripper flaps of the strand of the conveyor devices leading back to the inlet of the tensioning machine are held by a spring rest element in the open position, it can also be advantageous to form the actuating device of the mechanism for closing the gripper flaps as a wheel, the periphery of which coming into contact with the gripper flaps held in the open position is constructed so as to be elastically deformable. The special advantage of this construction lies in the simple and cost-saving production of this wheel with reliable closing function.

THE DRAWINGS

The invention is illustrated in the accompanying drawings which, in some cases are greatly simplified, and wherein:

FIG. 2 is a cross-sectional view along the line II—II in FIG. 1 and illustrating the disposition of a mechanism for closing the gripper flaps above the conveyor device, the actual closing element comprising a twin V-belt;

FIG. 3 is a partial cross-sectional view approximately along the line III—III in FIG. 1 and illustrating a mechanism for opening the gripper flaps adjacent to the conveyor device, the opening element also comprising a twin V-belt;

DETAILED DESCRIPTION

The general construction of the tensioning machine will be described first of all with the aid of FIG. 1 in connection with a first embodiment, to the extent that it is necessary for the explanation of the present invention.

Figure 1:
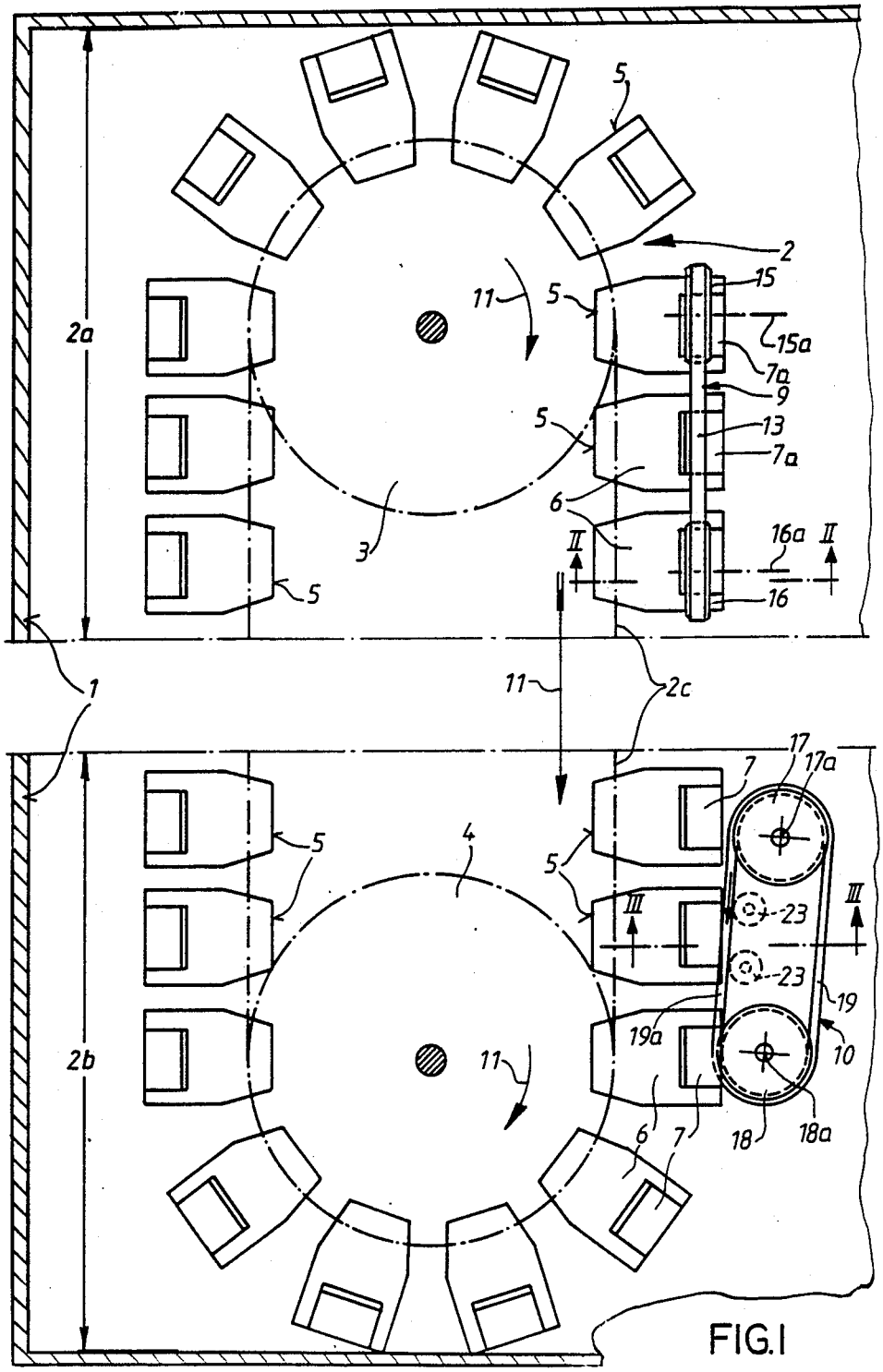
FIG. 1 is a fragmentary plan view of a tensioning machine according to the invention in the region of the two ends of a continuously moving conveyor device equipped with grippers.

For the sake of simplicity, of the overall construction of the tensioning machine only the tensioning machine housing 1 (and in particular the outer walls thereof) is indicated in FIG. 1. Of two conveyor devices having runs arranged parallel to one another and moving in a horizontal plane in a conventional manner, only one can be seen in plan view in the form of a gripper chain 2, and in fact for the sake of simplicity only the upstream and downstream ends 2*a* and 2*b*, respectively, of the runs are shown, the first end 2*a* being provided in the region of the inlet of the tensioning machine and the second end 2*b* in the region of the outlet of the tensioning machine. The gripper chain is of conventional construction and is turned at its ends 2*a* and 2*b* with the aid of turning wheels 3 and 4, respectively, which are of conventional construction. The gripper chain 2 carries a plurality of grippers 5 which are spaced from one another and each has a gripper body 6 on which a gripper flap 7 is pivotally mounted in a manner which is known per se, and the gripper flap 7 can be moved or pivoted—cf. for example FIG. 2—towards a gripper table 8 which is also carried on the gripper body 6. For this pivoting of the gripper flap 7 into its closed position, a mechanism 9 for closing the gripper flaps 7 (referred to in short below as a closer) is associated with the gripper chain 2 in the region of the inlet of the tensioning machine (i.e. in the region of the first end 2*a*) above the gripper chain 2, while a mechanism 10 for opening the gripper flaps 7 (referred to in short below as an opener) is associated with the gripper chain 2 in the region of the outlet of the tensioning machine (that is to say in the region of the second end 2*b*). This opener 10 is arranged on the side facing the length of material adjacent to the gripper chain 2 and above the plane of conveying the length of material, as will be explained in detail in the following description.

The gripper chain 2 is driven in the direction of the arrow 11 by known means which are not illustrated in detail. For the continuous conveyance through the treatment zones of the tensioning machine 1 of a length of material which is guided widthwise—and not shown in greater detail in FIG. 1—the gripper chains 2 hold the edges of the length of material firmly with the grippers 5 which are located in the respective conveying strand 2*c* thereof.

In addition to FIG. 1, reference will be made below to FIGS. 2 and 3 in order to explain a first embodiment of the closer 9 and the the opener 10. The gripper flap 7 of each gripper 5 is mounted on the gripper body 6 so as to be pivotal in the direction of the double arrow 7*b* and can be pivoted relative to the gripper table 8 in order to bring it into its closed position, in which it grips one edge 12 of the length of material against the gripper table 8, or into its open position, in which the edge 12 of the length of material can be taken up between the gripper flap and the gripper table or released therefrom. In the illustrated embodiment of the gripper 5, the gripper flap 7 has a pivot actuating lever 7*a* projecting over the upper surface of the gripper body 6.

In FIGS. 1 and 2 it can be seen that the closer 9 is arranged above the gripper chain 2. This closer 9 contains an actuating device which is formed essentially by a continuously moving closing element which in this case is constructed in the form of a twin V-belt 13 with a flexible but not expansible core 14 provided in its interior (center). This continuously moving twin V-belt 13 is passed over two turning wheels in the form of adapted V-belt pulleys 15, 16 which have a horizontal axis of rotation 15*a* and 16*a*, respectively. This belt drive formed by the twin V-belt 13 and the V-belt pulleys 15, 16 is arranged and retained above the gripper chain 2 in such a way that its lower strand 13*a* can be brought into contacting engagement with the pivot actuating levers 7*a* of the gripper flaps 7 in order to pivot the gripper flaps 7—according to the arrow 7*b*—into their closed positions when the grippers 5 run along below this strand 13*a*. This produces with the pivot actuating levers 7*a* of the gripper flaps 7, a substantially vertically oriented closed contacting engagement, as can be seen in FIG. 2. One of the V-belt pulleys 15 or 16 is advantageously driven by a drive means—which is known per se and has been omitted in the drawings for the sake of simplicity—in such a way that the lower strand 13*a* coming into contacting engagement with the pivot actuating levers 7*a* of the gripper flaps moves in the contacting region with the gripper flaps 7 in the same direction and at approximately the same speed as these gripper flaps. In this way, hardly any or only a comparatively small relative movement occurs between the actual closing element (twin V-belt 13) and the pivot actuating levers 7*a* of the gripper flaps 7.

In a similar manner to the closer 9, the opener 10 also contains a moving actuating device which is driven synchronously with the conveyor devices and is formed essentially by a closing element in the form of a twin V-belt 19 which is guided over turning wheels or V-belt pulleys 17, 18 and has in its interior (center), a flexible but inelastic core 20. However, in contrast to the closer 9, this opener 10 is arranged on the side facing the length of material (cf. edge 12 of the length of material adjacent to the gripper chain 2 or the grippers 5 thereof and above the plane of conveying the length of material (cf. the extension of the edge 12 of the length of material shown by a dot-dash line in FIG. 3). In this way, the continuously moving twin V-belt 19 acts together with the gripper flaps 7 in an essentially horizontally oriented open contacting engagement (cf. arrow 21 in FIG. 3), i.e. the gripper flaps 7 are pivoted towards the left in FIG. 3 for the purpose of opening when the twin V-belt 19 acts on it from the side. For this purpose, the V-belt pulleys 17, 18 have an essentially vertically extending axis of rotation 17*a* and 18*a*, respectively, for the actuating device.

It can also be seen in FIG. 1 that the strand 19*a* (the left-hand strand in FIGS. 1 and 3) of the continuously moving twin V-belt 19 coming into contacting engagement with the gripper flaps 7 runs inclined towards the conveyor strand 2*c* of the gripper chain 2 in the transport direction (arrow 11), and in a similar manner, the closer 9 arranged above the gripper chain 2 can also be inclined with its contacting strand 13*a* relative to the gripper chain 2. This arrangement of the actual closing and opening elements 13, 19 relative to the gripper chain 2 or the path of movement of the corresponding gripper flap parts has the advantage that the gripper flaps 7 do not come into engagement with the closing and opening elements abruptly but are pushed increasingly strongly by these elements into their open and closed position. This results in an additional gentle actuation of the gripper flaps 7 (in addition to the at least partially elastic material of the twin V-belt).

In addition to a certain cushioning effect between the V-belt pulleys and the gripper flaps, the construction of the continuously moving actuating devices in the form of twin V-belts 13 and 19 offers a number of other advantages: a twin V-belt essentially maintains its speed of movement even at the turning points; the twin V-belt and the appertaining V-belt pulleys have excellent lateral guiding; the inelastic core in the interior of the V-belt essentially prevents any alteration in length of such a twin V-belt.

As is indicated in simplified form and purely schematically at 22 in FIGS. 2 and 3, a spring rest element is advantageously also provided in the gripper body 6 and—as indicated by broken lines in FIG. 2—is in releasable locking engagement with the gripper flap 7 in its open position. By this means, the gripper flap 7 is reliably held in its open position when the gripper chain 2 is returning from the outlet of the tensioning machine to the inlet of the tensioning machine so that during this empty return transport, the gripper flap with its lower part (gripper blade) cannot come into engagement with the gripper table 8, which could result in the formation of an undesirable ridge on this lower flap part.

Instead of the indicated rest element 22, any other suitable stop arrangement (for example in the form of a catch) could of course be provided.

In the illustration of the opener 10 in FIG. 1, two rollers or wheels 23 (one or more than two such wheels are equally possible) are indicated by dot-dash lines co-operating with the strand 19*a* of the twin V-belt 19 coming into contacting engagement with the gripper flaps 7. The said rollers or wheels 23 serve as guide wheels and are used above all when the distance between the axes of the two V-belt pulleys 17 and 18 is relatively large and there is a danger of excessive bending of the V-belt strand 19*a* when it comes into engagement with the gripper flaps 7.

Whereas in the embodiment described above the opener and the closer contain a twin V-belt 13 or 19 as a continuously moving actuating device, instead of this other forms for the actual closing and opening elements can be used as the following examples show. In these, the gripper chain 2 with the grippers 5 mounted thereon can be designed in the same way as described above, and the same applies to the basic arrangement of the closer and opener, so that these parts which have already been explained have the same reference numerals in FIGS. 4 to 6 which are described below.

Figure 4:
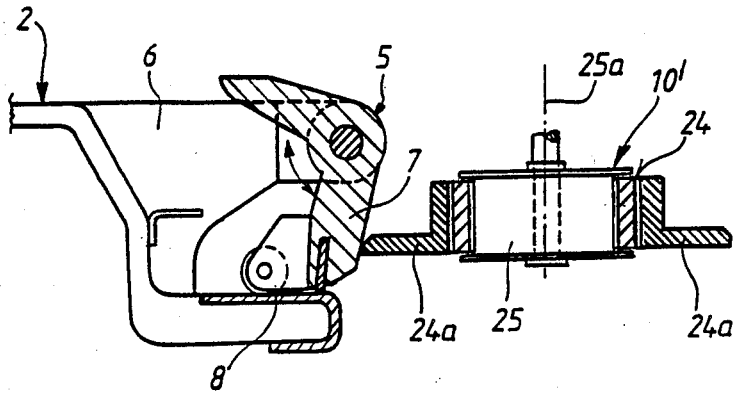
FIG. 4 is a partial cross-sectional view similar to FIG. 3, but with the opening element constructed as a toothed belt.
Figure 5:
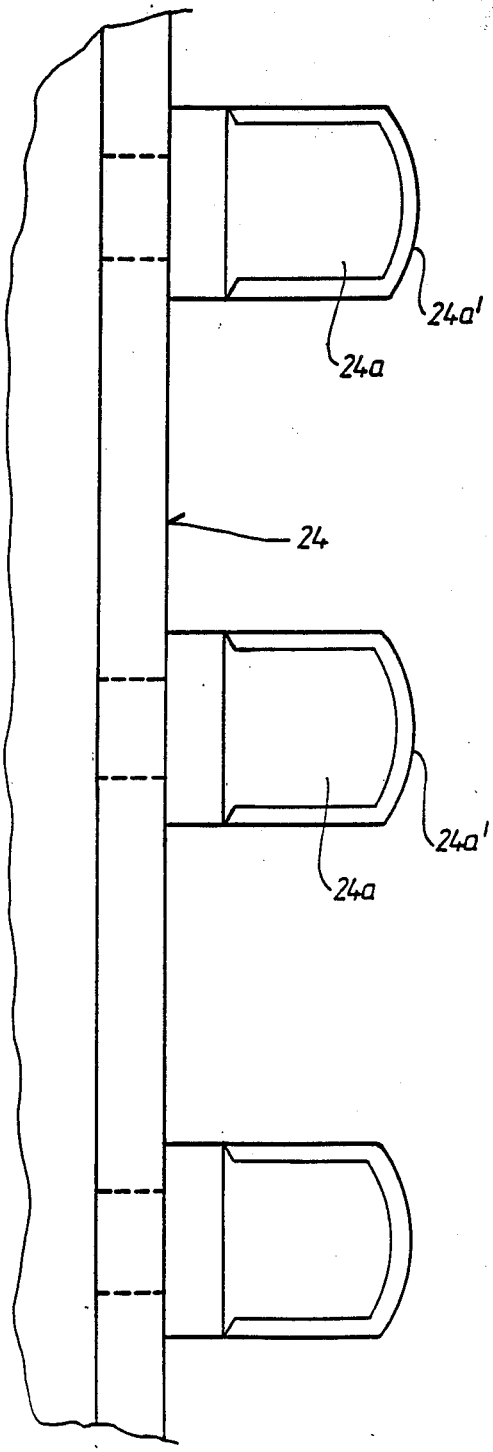
FIG. 5 is a fragmentary plan view of the toothed belt of FIG. 4.

In FIGS. 4 and 5, an embodiment of an opener 10' is illustrated in which the continuously moving opening element which acts from the side in a horizontal direction on the gripper flaps 7 and forms the actuating device is constructed in the form of a toothed belt 24 which, as in the case of the opener 10 in FIG. 1, is guided around two turning wheels 25 with vertical axes of rotation 25*a*. The continuously moving toothed belt 24 has on its outer peripheral side a plurality of teeth 24*a* spaced evenly from each other which—cf. also FIG. 5—are curved at their outwardly directed ends 24*a'* and with these ends come into contacting engagement with the gripper flaps 7. These teeth can be made from a relatively hard rubber-like material in order to be capable of producing a gentle contacting engagement with the gripper flaps 7.

Figure 6:
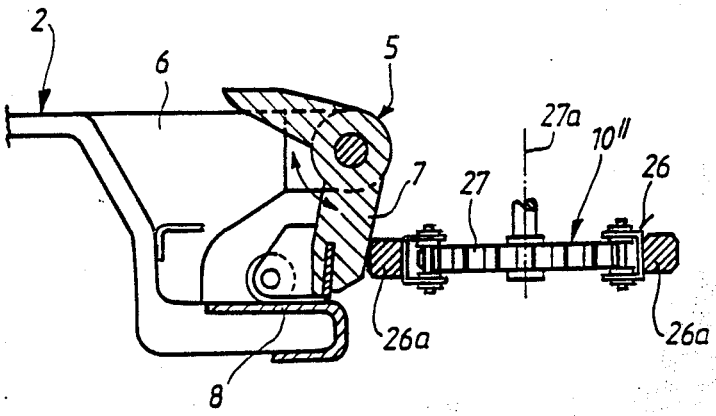
FIG. 6 is a cross-sectional view similar to FIG. 3, but with the opening element constructed as an open-link chain.

In the example of FIG. 6, the continuously moving opening element (actuating device) of the opener 10'' is constructed in the form of an open-link chain 26 which moves or is guided around two sprocket wheels 27 arranged with vertical axes of rotation 27*a*. In this case too, the opener 10''—up to the open-link chain 26 and the sprocket wheels 27—can be arranged, constructed and driven in the same way as was described in particular with the aid of FIG. 1 in connection with the opener 10.

The open-link chain 26—like the toothed belt 24 according to FIGS. 4 and 5—is equipped on its outer peripheral side with a plurality of teeth or small blocks 26*a* arranged equal distances apart which form projecting cushions (made for example from rubber or rubber-like material) and are mounted on the chain links so that they come into contacting engagement with gripper flaps 7 in order to open these flaps 7 in the manner already described above.

While in the embodiment according to FIGS. 4 and 6 the continuously moving toothed belt or the continuously moving open-link chain have only been described in connection with the opener, the closer can of course also be equipped in a similar manner with a continuously moving toothed belt or continuously moving open-link chain as a closing element (actuating device), and in this case the wheels or sprocket wheels are simply arranged in a corresponding manner with a horizontal axis of rotation.

In the examples according to FIGS. 4 to 6, it can also be advantageous for the reciprocal spacing of the teeth or blocks 24*a* and 26*a*, respectively, mounted on the toothed belt 24 and on the open-link chain 26, to be adapted to the spacing or distribution of the grippers 5 on the gripper chains 2. However, in all the embodiments of the opener and closer for the gripper flaps which have been described above, care is taken to ensure that the actual closing or opening element (actuating device) continuously moving over the wheels is driven synchronously with the conveyor devices, that is to say the gripper chains 2 provided in this case, and as this can take place in a conventional manner, it is not shown in greater detail in the drawings.

While in the embodiments described with the aid of FIGS. 1 to 6, the moving actuating device of the opener and closer is formed in each case by a continuously moving element guided over turning wheels, this actuating device can also be formed by a wheel, the outer periphery of which is in corresponding contacting engagement with the grippers 5 in order to close or open the gripper flaps 7 in a corresponding manner, and in this case too, the wheel forming the actuating device is driven synchronously with the gripper chains 2, that is to say the conveyor devices, so that this wheel moves in the same direction and at approximately the same speed as the gripper flaps in the region of the zone of contact with the gripper flaps 7.

An embodiment of such an actuating device which is constructed in the form of a wheel 31 and is contained in an arrangement for opening the gripper flaps 7 (again referred to in short below as the opener) is described below with the aid of FIGS. 7 to 10. Since the tensioning machine and the tensioning machine housing 1 and the gripper chain 2 with its grippers 5 can be constructed in the same way as in the preceding examples, the same reference numerals are again used therefor so that these parts do not have to be explained again.

Figure 7:
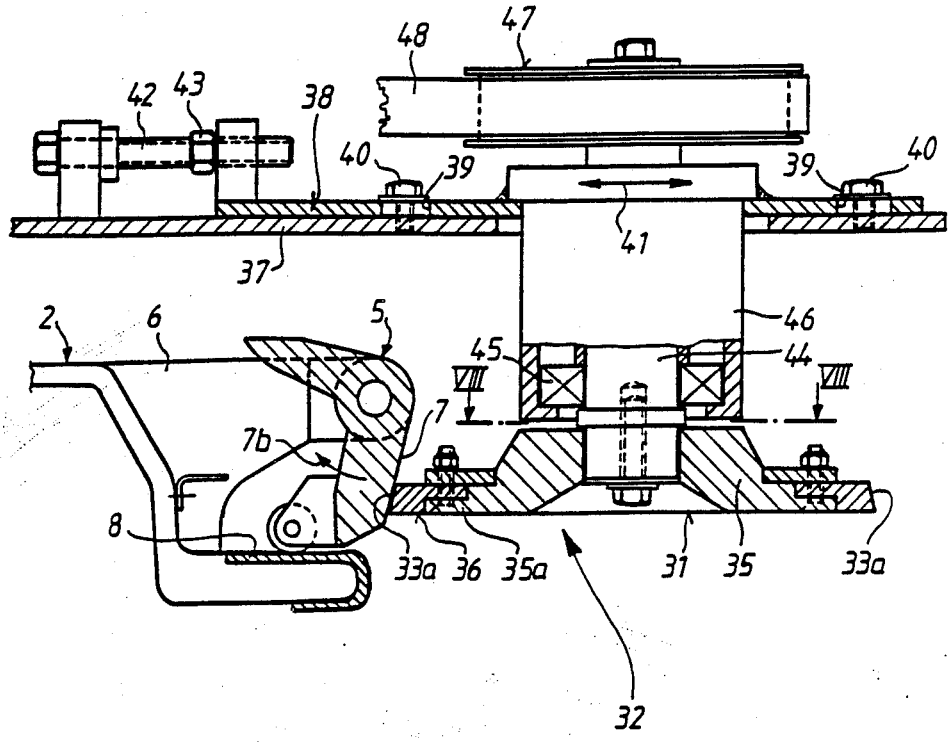
FIG. 7 is a cross-sectional view similar to FIG. 3, but with the actuating device formed by a wheel having cam surfaces.
Figure 9:
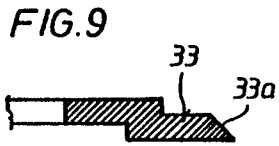
FIGS. 9 and 10 are sectional views along the lines IX—IX and X—X, respectively, of FIG. 8.
Figure 10:
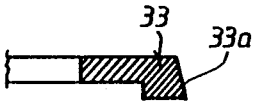
Figure 8:
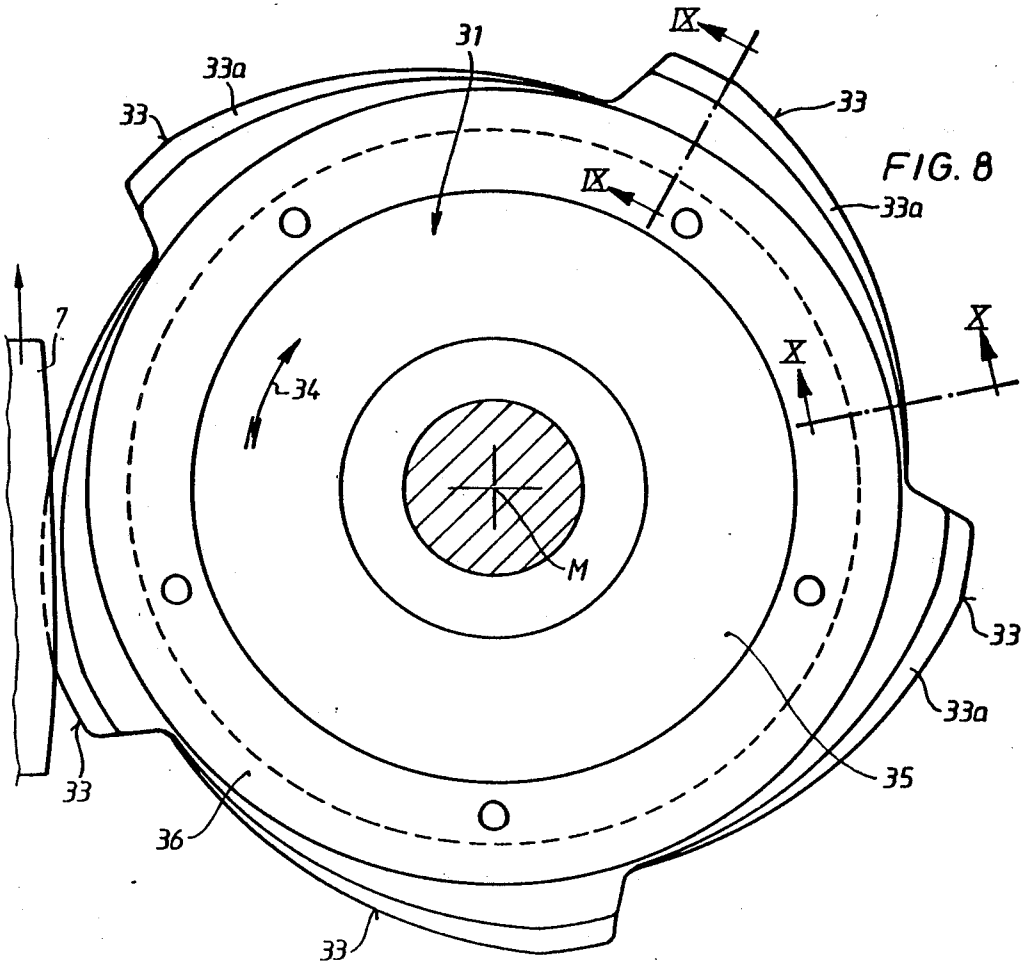
FIG. 8 is a sectional view taken on the line VIII—VIII of FIG. 7.

The essential parts for the construction of this opener 32 can be seen in the partial section view in FIG. 7, while the more detailed construction of the actuating device in the form of a wheel 31 can be seen from FIG. 8 with the relevant partial sectional views according to FIGS. 9 and 10.

The wheel 31 of this opener 32 has a plurality of cam surfaces 33 rising in the radial direction on its periphery and engageable with the closed gripper flaps 7. In the illustration in FIG. 8, five cam surfaces 33 are provided which are evenly distributed over the outer periphery of the wheel 31; naturally any other suitable number of cam surfaces can be provided and adapted to the particular construction. The pitch of the cam surfaces increases in the direction of rotation (arrow 34) of the wheel 31, and the maximum radial extension of the cam surfaces 33 will depend upon the minimum size of the pivot movement of the gripper flaps 7 in the direction of the arrow **7*b*. Furthermore, the form of each cam surface is such that a continuously curving cam surface edge 33*a* is produced which ensures that the gripper flaps 7 are picked up relatively without jerking by these cam surfaces 33** and pivoted into the open position.

For the last-mentioned purpose, it is also advantageous if the cam surfaces 33 not only continuously increase in the radial dimension against the direction of rotation (arrow 34) but if in addition, the outer cam surface edge **33*a* has a chamfer running in the axial direction which is adapted to the respective pivot position of the gripper flaps 7 and—as shown in FIGS. 9 and 10—is greatest (FIG. 9) in the region of the greatest radial distance of the cam surface edge 33*a* from the central point M of the wheel 31 and is smallest in the region of the smallest radial distance (FIG. 10**).

The construction of this wheel 31 is also advantageously such that it contains a hub-like foundation 35 with a cam ring 36 screwed and therefore removably connected to the outer peripheral section **35*a* thereof. This cam ring 36 has the cam surfaces 33** referred to above on its outer periphery.

The cam ring 35 is preferably made from a stable temperature-resistant plastic material which has a low coefficient of friction (and is therefore particularly capable of sliding) and is also stabilized preferably by quantities of glass fiber or the like.

It should basically be stated in connection with the further construction of the opener 32 that the wheel 31 is retained in a suitable manner so that its axis of rotation M is stationary relative to the gripper chain 2.

In the embodiment illustrated in FIG. 7, the opener 32 is held, for example, on a part 37 of the tensioning machine housing 1 with the aid of a mounting plate 38 which has at least two longitudinal slots 39 through each of which a bolt 40 screwed into the housing part 37 engages in such a way that the mounting plate 38 and with it the opener 32 with the wheel 31 can be displaced in the direction of the double arrow 41. In this way, the opener 32 and in particular the wheel 31 thereof can be adjusted in the necessary manner in its relative position with respect to the closed gripper flap 7. This adjustment can also be carried out extremely sensitively with the aid of an adjusting screw 42 with a lock nut 43. This adjusting screw 42 is arranged—as FIG. 7 shows—between the stationary part 37 of the tensioning machine housing and the mounting plate 38.

The wheel 31 of this opener 32 is also mounted so as to be fixed on the lower end of a spindle 44 which is arranged by means of bearings 45 in a bush 46 which is firmly connected to the mounting plate 38. A belt pulley, preferably a toothed belt pulley 47, is mounted at the upper end of the spindle 44 projecting out of the bush 46 and co-operates with a toothed belt 48 and together with the toothed belt pulley 47 is part of a toothed belt drive which is connected in a manner which is known per se to the drive of the appertaining gripper chain 2 in such a way that the wheel 31 is driven synchronously with the gripper chain 2.

A closer for the gripper flaps 7 could also be constructed in a similar way to that already explained with the aid of FIGS. 7 to 10. However, it has proved sufficient if in the case of a gripper construction of the type described above with the aid of FIGS. 1 to 3, the actuating device of the arrangement for closing the gripper flaps (that is to say the closer) is formed by a wheel, the outer periphery of which is engageable with the gripper flaps 7 held in the open position is—in contrast to the wheel 31 described above—constructed so as to be elastically deformable and with a continuously extending peripheral edge (that is to say without cam surfaces or the like). The drive and the mounting for this closer wheel can otherwise be constructed in a similar manner to that described with the aid of FIG. 7 so that it is not necessary to illustrate this closer wheel in the drawings.

Finally, it should be mentioned again that even in the case of the construction of the moving actuating device in the form of a wheel for the arrangements for opening and closing the gripper flaps, the closer and the opener can be arranged in the same form above or adjacent to the gripper chain 2 as was explained with the aid of FIG. 1 in connection with the openers and closers 9 and 10, respectively.

I claim:

1. In a tensioning machine for the treatment of a length of textile fabric, said machine including:

(a) an endless conveyor strand movable continuously along a horizontal fabric conveying path from a fabric inlet end to a fabric outlet end, and return, and (b) a plurality of spaced apart grippers carried by said conveyor strand, each of said grippers having a support table for supporting one edge of said fabric and a two-arm flap rockable about a horizontal axis between said arms and above said table between a closed position in which a first arm of said flap on one side of said axis and at a level between said axis and said table is enabled to clamp said fabric against said table and an open position in which said first arm of said flap is disabled from clamping said fabric against said table, each of said flaps having its second arm on the opposite side of said axis, the improvement comprising:

(c) flap closing means at the inlet end of said path engageable with the second arm of each of said flaps for rocking each of said flaps to its closed position as it arrives at said inlet end, (d) continuously movable flap opening means at the outlet end of said path for rocking each of said flaps to its open position as it arrives at said outlet end;

(e) releasable latch means for releasably maintaining said flap in its open position during the return of said strand from the outlet end to the inlet end;

(f) means mounting said flap opening means alongside said conveyor strand in the path of movement of each of said flaps and at such level as to engage said first arm of each of said flaps between said axis and said table with sufficient force to rock each such flap from its closed position to its open position and to effect latching engagement of said flap with said latch means; and (g) means for continuously driving said flap opening means in the direction of movement of said conveying path and at substantially the same speed as said conveyor strand.

2. A tensioning machine according to claim 1 wherein said flap opening means comprises an endless strand trained around two spaced apart turning wheels to form two runs, one run of said strand being engageable with said first arm of each of said flaps.

3. A tensioning machine according to claim 2 wherein said one run of said strand that is engageable with said first arm is inclined transversely relative to said conveying path.

4. A tensioning machine according to claim 2 wherein said strand of said flap opening means has a core formed of flexible, inelastic material.

5. A tensioning machine according to claim 2 wherein said strand of said flap opening means comprises a twin V-belt.

6. A tensioning machine according to claim 2 wherein said strand of said flap opening means comprises a belt having teeth spaced according to the spacing of said grippers.

7. A tensioning machine according to claim 2 wherein said strand of said flap opening means comprises a chain having cushions thereon spaced according to the spacing of said grippers.

8. A tensioning machine according to claim 1 wherein said flap opening means comprises a wheel whose periphery is engageable with said first arm.

9. A tensioning machine according to claim 8 wherein said wheel has a series of cams on its periphery spaced according to the spacing of said grippers.

10. A tensioning machine according to claim 9 wherein said cams are carried by a ring removably mounted on said wheel.

11. A tensioning machine according to claim 8 including means for adjusting the position of said wheel relative to said grippers and transversely of said conveying path.

12. A tensioning machine according to claim 8 wherein said wheel has an elastically deformable rim.

13. A tensioning machine according to claim 8 wherein said wheel has a chamfered rim.

14. A tensioning machine according to claim 8 wherein said wheel has a series of radially varying cams on its periphery spaced according to the spacing of said grippers, each of said cams having an axially chamfered rim which varies in pitch peripherally, said pitch being greatest in the region of the greatest radial dimension of said cam.

* * * * *